US008757168B2

(12) United States Patent
Wills

(10) Patent No.: US 8,757,168 B2
(45) Date of Patent: Jun. 24, 2014

(54) CIGAR HOLDER

(76) Inventor: Gary Wills, Jasper, CO (US)

( * ) Notice: Subject to any disclaimer, the term of this patent is extended or adjusted under 35 U.S.C. 154(b) by 0 days.

(21) Appl. No.: 13/544,428

(22) Filed: Jul. 9, 2012

(65) Prior Publication Data

US 2014/0007890 A1 Jan. 9, 2014

(51) Int. Cl.
*A24F 13/02* (2006.01)

(52) U.S. Cl.
USPC ..... 131/260; 131/190; 131/241; 131/257

(58) Field of Classification Search
USPC ..... 131/240.1–242.6, 257–260
See application file for complete search history.

(56) References Cited

U.S. PATENT DOCUMENTS

| | | | | |
|---|---|---|---|---|
| 2,047,786 | A * | 7/1936 | Kuntz | 131/260 |
| 5,524,646 | A | 6/1996 | Reich | |
| 5,588,448 | A | 12/1996 | Photakis | |
| 5,816,262 | A | 10/1998 | Javnozon | |
| 5,842,481 | A * | 12/1998 | King | 131/187 |
| 5,868,143 | A | 2/1999 | Nielsen | |
| 6,109,271 | A * | 8/2000 | Webber et al. | 131/240.1 |
| 6,234,179 | B1 | 5/2001 | Alcaraz | |
| 6,363,941 | B1 | 4/2002 | Combs | |
| 6,435,192 | B1 * | 8/2002 | Cancellera | 131/242 |
| 6,796,913 | B2 | 9/2004 | Tummillo | |
| 7,387,127 | B1 | 6/2008 | Braun | |
| 7,661,431 | B1 | 2/2010 | Barrios | |
| 7,854,664 | B1 | 12/2010 | Comrie | |
| 2010/0139673 | A1 * | 6/2010 | Miller | 131/187 |
| 2011/0094525 | A1 * | 4/2011 | Maal | 131/280 |
| 2011/0253154 | A1 | 10/2011 | Dolciato | |

OTHER PUBLICATIONS

CigarMinder, Inc., How It Works, www.cigarminder.com/WORKS.HTM, Feb. 8, 2012, 2 pgs.

* cited by examiner

*Primary Examiner* — Richard Crispino
*Assistant Examiner* — Eric Yaary
(74) *Attorney, Agent, or Firm* — Marsh Fischmann & Breyfogle LLP

(57) ABSTRACT

A cigar holder operable to retainably engage a cigar. The cigar holder may include a cigar retention member and a clamping assembly. The cigar retention member may be positionable with respect to the clamping assembly to supportably retain a cigar therein when the clamping assembly is secured to a number of different support structure orientations. In an embodiment, the jaw assembly may comprise a base support structure for supportably engaging the cigar holder on a surface.

13 Claims, 7 Drawing Sheets

CIGAR HOLDER

BACKGROUND

Many individuals enjoy the use of tobacco products such as cigars and cigarettes when participating in outdoor recreational activities such as, for example, golf. While the following discussion describes certain problems attendant to cigars when golfing, it will be understood similar problems may be presented when attempting to enjoy any tobacco product while participating in many other activities.

For example, holding a cigar (e.g., in one's hand or mouth) while playing golf may be impractical or inconvenient. Accordingly, an individual may set his or her cigar down on the ground when it is inconvenient to hold the cigar (e.g., while swinging, putting, etc.). This may contaminate the cigar by exposing the cigar to chemicals (e.g., pesticides, herbicides, fertilizers, etc.) and/or natural debris (e.g., sand, cut blades of grass, dirt, etc.).

In response, the cigar maybe placed on a cart, bag, or other structure. However, in this case, the cigar may be knocked from the surface on which it was placed, thus contaminating the cigar. Furthermore, if the cigar is lit, placing the cigar on such a structure may result in damage to the structure as the cigar may burn, singe, discolor, or otherwise damage a structure adjacent to the cigar.

Certain holding devices have been contemplated that provide a structure to retain a cigar. However, these devices oftentimes include clamping structures or other mechanisms that compress the cigar (i.e., apply a compressive force radially with respect to the cigar). Such application of a compressive force to retain the cigar may damage the cigar by, for example, crushing the tobacco disposed within the cigar wrapper, piercing the wrapper, causing uneven burn rates, causing the cigar to be difficult to draw from, etc. Furthermore, certain holding devices have been contemplated that provide a cradle or the like to hold the cigar. However, such devices have been limited to a single orientation of the cigar (e.g., resting on top of a support structure or the like that is only positionable in one orientation).

SUMMARY

The present disclosure describes cigar holders that may address one or more of the foregoing issues and/or present other advantages that may be appreciated from the following description. For example, cigar holders are described herein that may retainably engage a cigar when attached to support structures in a variety of orientations. Furthermore, the cigar holders described herein may retain a cigar without imparting a compressive force on the cigar, regardless of the orientation of the support structure to which the cigar holder is attached.

For instance, a first aspect described herein includes a cigar holder. The holder includes a cigar retention member operable to retainably engage a cigar without application of a compressive force to the cigar. The holder further includes a clamping assembly operable to clampingly engage a support structure. The cigar retention member is adjustably positionable relative to the clamping assembly to accommodate retainable engagement of the cigar for various support structures with which the clamping assembly is engageable.

A number of feature refinements and additional features are applicable to the first aspect. These feature refinements and additional features may be used individually or in any combination. As such, each of the following features that will be discussed may be, but are not required to be, used with any other feature or combination of features of the first aspect.

For example, in one embodiment, the cigar retention member may be adjustably positionable in a plurality of relative positions with respect to the clamping assembly to accommodate retainable engagement of the cigar when the clamping assembly is engaged with support structures varying between horizontally oriented support structures and vertically oriented support structures. In this regard, the cigar retention member may include a cigar cradle extending in a first direction corresponding to a length of the cigar and a second direction corresponding to a circumference of the cigar. In one embodiment, the cigar cradle may extend in the first direction at least about 5 cm. In one embodiment, the cigar cradle may extend in the second direction sufficient to retainably engage a cigar with a diameter of up to about 2.5 cm.

In order to accommodate retainable engagement of the cigar, the cigar retention member may be adjustably positionable with respect to the clamping assembly with respect to at least a first degree of freedom. For instance, in one embodiment, the cigar retention member may be adjustably positionable (e.g., pivotal) with respect to the clamping assembly through at least 30 degrees, at least 45 degrees, at least 90 degrees, or even at least 120 degrees of rotation in the first degree of freedom. Furthermore, the cigar retention member may be adjustably positionable with respect to the clamping assembly with respect to at least a second degree of freedom of movement between the cigar retention member and the clamping assembly. In one embodiment, the cigar retention member may be adjustably positionable (e.g., pivotal) with respect to the clamping assembly through at least 90 degrees, at least 120 degrees, at least 180 degrees, or even at least a full 360 degrees of rotation in the second degree of freedom.

In one embodiment, the cigar cradle may include a riser disposed at a first end portion thereof. The riser may be operable to dispose a lit end portion of the cigar in a spaced apart relation from the cigar cradle adjacent to the lit end portion of the cigar. As such, the riser comprises a heat-resistant material and may prevent scorching, burning, or other damage of the cigar cradle adjacent to the lit portion of the cigar. The cigar cradle may include a hood at a second end portion thereof opposite the first end portion. At least a portion of a cut end portion of the cigar may be substantially surrounded by the hood when the cigar is retainably engaged by the cigar retention member. In this regard, the cut end portion of the cigar (i.e., the end portion introduced into the mouth of the user) may be protected by the hood to limit the amount of debris that may come into contact with the cut end of the cigar. In this regard, in one embodiment, at least a majority of the cut end portion of the cigar is surrounded by the hood when the cigar is retainably engaged by the cigar retention member.

In another embodiment, the clamping assembly may include a support structure defining a base portion. The base portion may be positionable with respect a surface to supportably position the cigar retention member with respect to the surface. As such, in addition to clampingly engaging a support structure, the base portion may be supportably positioned on a surface (e.g., a horizontal surface such as a table, a cart seat, or even the ground). In this regard, in one embodiment, the clamping assembly may comprise a first handle portion and a second handle portion. The first and second handle portions may be disposable with respect to one another, such that the first and second handle portions define a jaw member of the clamping assembly, and the first and second handle portions comprise the support structure defining the base.

In one particular embodiment, the jaw member may be selectively openable to define a jaw span of at least about 7.5 cm.

A second aspect described herein includes a method for retaining a cigar. The method includes supportably engaging the cigar holder with a support structure and positioning a cigar retention member based on a position of the cigar holder as supportably engaged with the support structure. In this regard, the cigar retention member may be adjustable with respect to the support structure. The method further includes retaining a cigar in the cigar retention member such that the retaining is without application of a compressive force to the cigar.

A number of feature refinements and additional features are applicable to the second aspect. These feature refinements and additional features may be used individually or in any combination. As such, each of the following features that will be discussed may be, but are not required to be, used with any other feature or combination of features of the second aspect.

For example, in one embodiment, the supportably engaging operation may include clamping a clamping assembly of the cigar holder to the support structure. Alternatively, the supportably engaging operation may include resting the cigar holder on a surface, wherein the cigar holder is supported by a support structure including a supportive base.

A third aspect disclosed herein includes a cigar holder. The holder includes support means for supportably engaging the cigar holder with a support structure and retention means for retaining a cigar, wherein the retaining is without application of a compressive force to the cigar. The holder further includes positioning means for positioning the cigar retention member relative to the support means.

DETAILED DESCRIPTION

The following description is not intended to limit the invention to the form disclosed herein. Consequently, variations and modifications commiserate with the following teachings, skill, and other knowledge of the relevant art are within the scope of the present invention. The embodiments described herein are further intended to explain modes known of practicing the invention and to enable others skilled in the art to utilize the invention in such, or other embodiments, and with various modifications required by the particular application(s) or use(s) of the invention.

Figure 1:
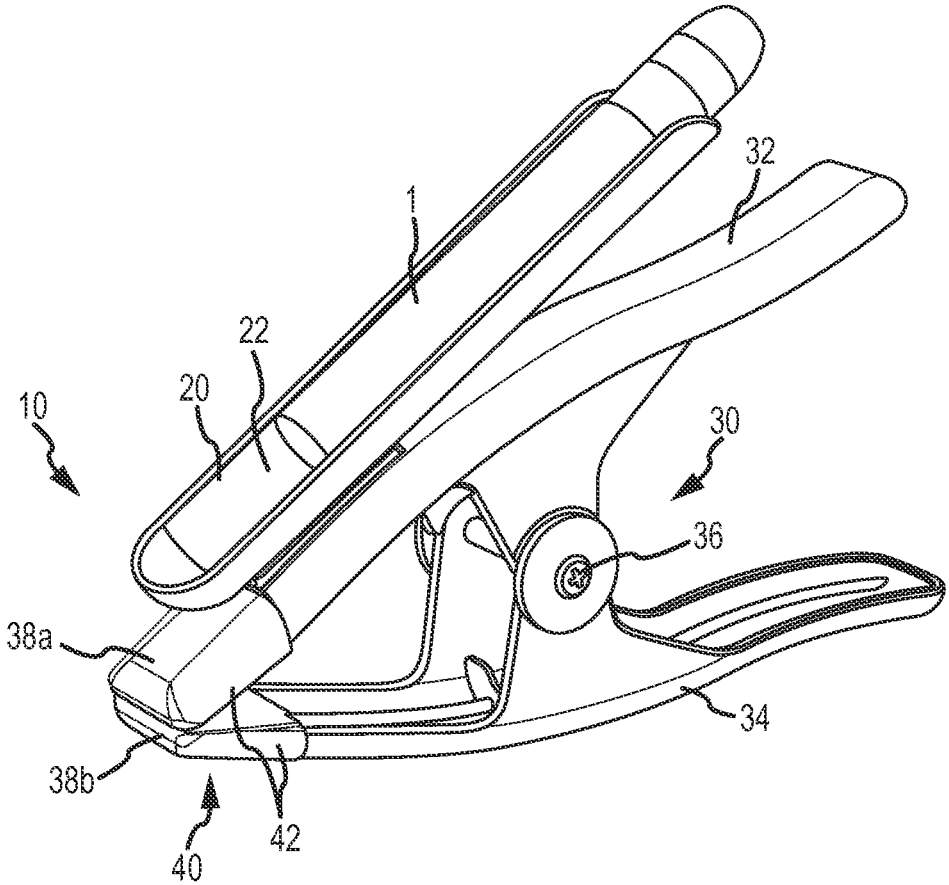
FIG. 1 is a perspective view of an embodiment of a cigar holder with a cigar disposed with respect to a cigar retention member thereof.

FIG. 1 depicts an embodiment of a cigar holder 10. The cigar holder 10 includes a cigar retention member 20 that is connected to and positionable relative to a clamping assembly 30. The retention member 20 is positionable relative to the clamping assembly 30 in a number of different positions as will be described in greater detail below. In this regard, the cigar retention member 20 may be positioned relative to the clamping assembly 30 so as to retain a cigar 1 when the clamping assembly 30 is engaged with a plurality of different support structures (e.g., support structures ranging from vertical to horizontal support structures).

The clamping assembly 30 may include a first handle portion 32 and a second handle portion 34. The first handle portion 32 may be connected to and moveable with respect to the second handle portion 34 at a pivot 36. The first handle portion 32 may include a first jaw end portion 38*a* and the second handle portion 34 may include a second jaw end portion 38*b*. The first and second jaw end portions 38*a* and 38*b* may define a jaw member 40. The first and second jaw end portion 38*a* and 38*b* may include a covering material 42. The covering material 42 may be selected to provide favorable surface characteristics of the jaw end portions 38*a* and 38*b* to assist in grippingly engaging a support structure clamped between the jaw end members 38*a* and 38*b*. In this regard, the covering material 42 may be an elastomeric material such as silicone, a soft plastic, rubber, or the like. In another embodiment, the jaw end members 38*a* and 38*b* may include other features that promote attachment to a support structure like, for example, a knurled surface, teeth, etc.

In this regard, the first handle portion 32 and the second handle portion 34 may be biased such that the first jaw end portion 38*a* is biased into contact with the second jaw end portion 38*b*. The biasing force tending to retain the first jaw end portion 38*a* in contact with the second jaw end potion 38*b* may also, in turn, generate a clamping force for engaging a support structure between the first jaw end portion 38*a* and the second jaw end portion 38*b*. In this regard, a biasing member (not shown) may be provided to bias the first jaw end portion 38*a* in contacting engagement with the second jaw end portion 38*b*. The biasing member may be, for example, chosen to exert sufficient force to engage the support structure to supportably engage the cigar holder 10 and cigar 1. The biasing member may be, for example, a spring such as a coil spring, leaf spring, or other member with a sufficient spring constant. The biasing member may be, for example, disposed at the pivot 36 to exert the biasing force on the first and second handle portions 32 and 34 as described above.

The jaw member 40 may engage a variety of support structures as will be discussed in greater detail below. In this regard, in one embodiment, the jaw member 40 may be opened to define a jaw span 60 (best shown in FIG. 2) that is at least about 3 cm. In one embodiment, the jaw span 60 may be not less than about 5 cm and not greater than about 10 cm. In one embodiment, the jaw span 60 may be at least about 7.5 cm to accommodate position of a support structure between the first jaw end portion 38*a* and the second jaw end portion 38*b*.

The jaw member 40 may be disposed between a closed position (shown in FIG. 1) and an open position (shown in FIG. 2) by application of a force on the first and second handle portions 32 and 34 (e.g., squeezing the first and second handle portions 32 and 34). In this regard, the first and second handle portions 32 and 34 may be moved together on a side of the pivot 36 opposite the jaw end portions 38*a* and 38*b* to expand the jaw end portions 38*a* and 38*b* to define the jaw span 60.

In other embodiments, alternative clamping assembly 30 arrangements may be provided. For example, the clamping assembly may comprise a C-clamp, bar clamp, pipe clamp, etc. Furthermore, alternative attachment mechanisms may be employed such as, for example, magnetic connections or the like.

The cigar retention member 20 may be operable to retainably engage a cigar 1. In this regard, the cigar retention member 20 may include a cigar cradle 22. The cigar cradle 22 may extend in a first direction corresponding to the length of the cigar 1. For example, the cigar cradle 22 may extend in the first direction at least a length of about 5 cm. In another embodiment, the cigar cradle 22 may extend in the first direction at least a length of about 7 cm, 10 cm, or even 15 cm. In this regard, the cigar cradle 22 may extend in the first direction a distance corresponding to at least a majority of the length of the cigar 1, beyond the length of the cigar 1, or to any other useful length.

The cigar cradle 22 may also extend in a second direction corresponding to the circumference of the cigar 1. Cigars 1 are commonly sized by the cigar's ring gauge, where the ring gauge value represents the diameter of the cigar in 64ths of an inch (0.4 mm). In this regard, the cigar cradle 22 may extend in the second direction sufficiently to support a cigar with a ring gauge of 60 or larger. In this regard, to sufficiently support a cigar, the dimension of the cigar cradle 22 in the second direction (e.g., the size of the cigar cradle 22 corresponding to the circumference of the cigar 1) may have a radius of curvature at least as large as the corresponding radius of the cigar 1. As such, as the cradle 22 may support a cigar with a ring gauge of 60 or larger, the radius of curvature of the cradle 22 may be at least about 1.2 cm.

In any regard, the cigar cradle 22 may extend in the second direction such that the cigar cradle 22 extends along at least a portion of the cigar 1 in the second direction. For example, the cigar cradle 22 may extend about at least a majority of the circumference of the cigar 1. The cigar cradle 22 may extend about the circumference of the cigar 1 even if the cigar cradle 22 does not exactly follow the contour of the circumference of the cigar 1 (as may be the case where a cigar 1 having a ring gauge smaller than the largest cigar 1 supportable by the cradle 22 is disposed in the cradle 22). Furthermore, the cradle 22 may have a different cross sectional profile than the arcuate cross sectional profile shown. For example, the cross sectional profile may be a "V" shaped trough, a partial hexagonal cross section, or other combination of linear and/or non-linear segments that generally extend about the circumference of the cigar 1.

In another embodiment that will be discussed in greater detail below, the cradle 22 may have a portion that extends about the entire circumference of at least a portion of the cigar 1 (e.g., the cradle 22 may include a substantially tubular portion at least along a portion of the length of the cradle 22). It will be appreciated that the cradle 22 supportably engages the cigar 1 without application of a compressive force thereto. In this regard, the probability of damaging the cigar 1 during the retention may be limited.

Figure 2:
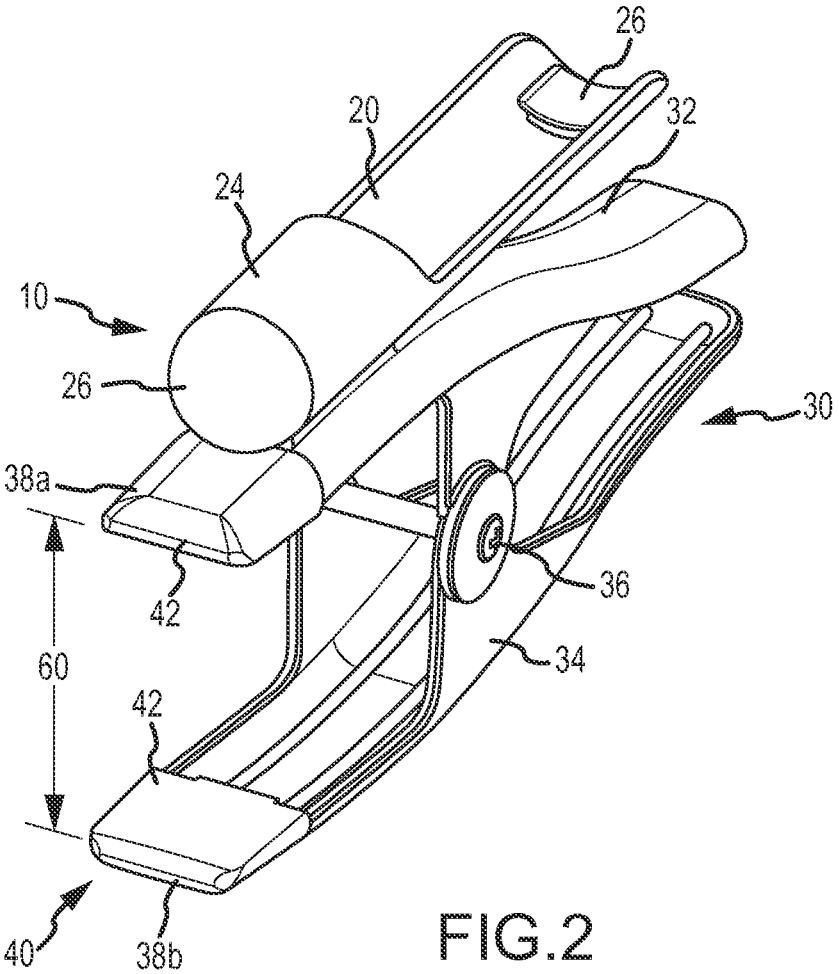
FIG. 2 is a perspective view of an embodiment of a cigar holder with a clamping assembly in an open position.

For example, with further reference to FIG. 2, another embodiment of a cigar holder 10 is shown. The cigar holder 10 may include a clamping assembly 30 generally as described above with respect to the embodiment of FIG. 1. The cigar retention member 20 may include similar features as those described above with FIG. 1. Furthermore, the cigar retention member 20 shown in FIG. 2 may include a hood 24 that may extend about the entire circumference of a cigar disposed in the cradle 22. The hood 24 may include a capped end portion. Additionally or alternatively, the cigar retention member 20 may include other portions that extend about the entire circumference of the cigar 1 as described above.

The cradle 22 may also include a riser 26. The riser 26 may be provided at an end of the cigar cradle 22 generally opposite the hood 24 (e.g., in the case where the hood 24 is disposed at only a first end of the cradle 22). In this regard, when a cigar 1 is positioned in the cradle 22, a cut end of the cigar 1 may be positioned adjacent to the hood 24 such that a lit end of the cigar 1 opposite the cut end may be adjacent to and/or resting on the riser 26. In this regard, the riser 26 may space away the lit end of the cigar 1 from the cradle 22. It will be appreciated that the lit end of the cigar 1 may generate significant heat. In this regard, the riser 26 may be constructed from a heat resistant material. For example, the riser 26 may be constructed from a heat resistant polymer, a ceramic, a metal, or any other appropriate material capable of withstanding heat consistent with a burning cigar. As such, damage to the cradle 22 may be reduced as the lit end of the cigar 1 may be maintained some distance from the cradle 22 by the riser 26.

Figure 3A:
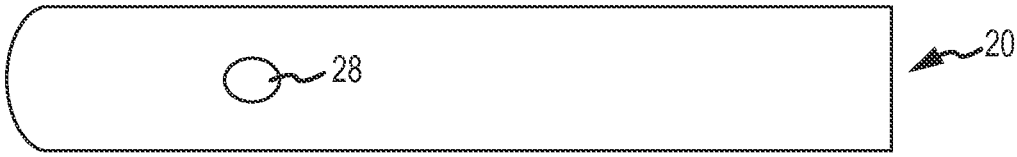
FIG. 3A is a bottom view of an embodiment of a cigar retention member.
Figure 3B:
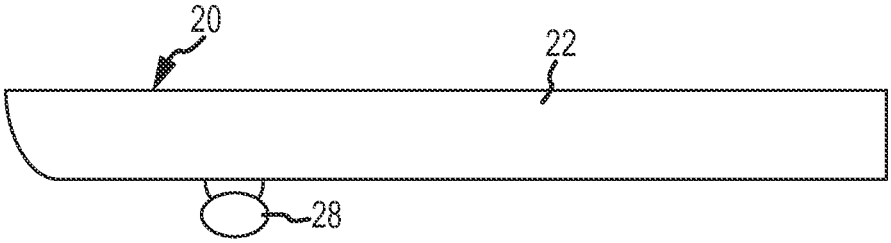
FIG. 3B is a side view of the cigar retention member of FIG. 3A.

With further reference to FIGS. 3A and 3B, a bottom and side view of an embodiment of a cigar retention member 20 is shown. Additionally, in FIGS. 4A-4C, a front view of a cigar holder 10 is shown with the cigar retention member 20 in various positions with respect to the clamping assembly 30. As discussed above, the cigar retention member 20 may include a cigar cradle 22. The cradle 22 may have a ball 28 connectedly engaged on a bottom portion of the cradle 22. The ball 22 may engage a socket 44 defined in the first handle portion 32. In this regard, the cradle 22 may be connectably engaged with the first handle portion 32 by way of a resulting ball and socket joint. In another embodiment, an alternative connection between the cigar retention member 20 and the clamping assembly 30 may be provided. For example, the cigar retention member 20 may be positionably connected to the clamping assembly 30 by way of a hinge, pivot, linkage, joint, or other positionable connection without limitation.

Furthermore, in various embodiments, the cradle 22 may be positionably connected to the clamping assembly 30 at various locations along the length of the cradle 22. For example, the cradle 22 may be positionably connected to the clamping assembly 30 adjacent to an end portion thereof, a midpoint thereof, or any other location on the clamping assembly. Furthermore, the positionable connection may be located in other locations on the clamping assembly 30 than that shown (e.g., closer to the jaw end portion 38*a*, further from the jaw end portion 38*a* than shown, or on an opposite side of the first handle portion 32 than as shown).

Figure 4A:
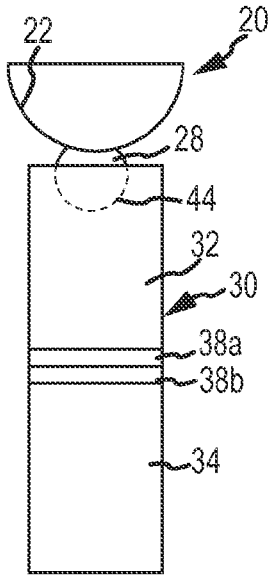
FIGS. 4A-4C are front views of the cigar holder with the cigar retention member in various respective positions with respect to the clamping member.
Figure 4B:
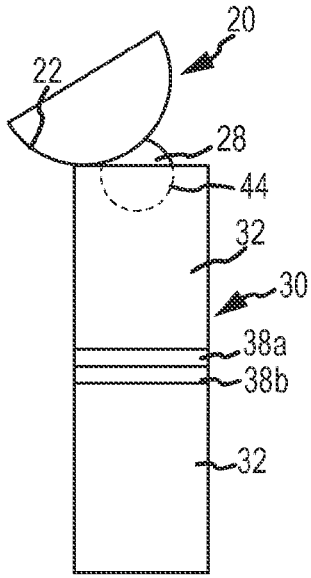
Figure 4C:
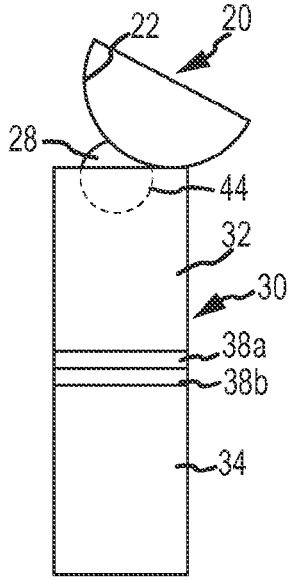

As depicted in FIGS. 4A-4C, the ball and socket joint defined by the ball 28 and socket 44 may provide a first degree of freedom, wherein the cradle 22 can be angularly positioned with respect to the clamping assembly 30 in a number of positions. In the embodiment depicted, the ball and socket joint may provide a continuum of positions corresponding to a range of angles in the first dimension. For example, the cradle 22 may be moved with respect to the clamping assembly 30 through a range of angles including at least about 30 degrees of movement in the first dimension. In another embodiment, the range of angles in which the cradle 22 may be disposed in the first dimension may be not less than about 45 degrees and not greater than about 120 degrees. In another embodiment, the cradle 22 may be moved with respect to the clamping assembly 30 in a range of angles including at least about 90 degrees or even about 180 degrees of movement in the first dimension. In still another embodiment, a plurality of discrete positions between the cigar cradle 22 and the clamping assembly 30 may be provided.

Figure 5A:
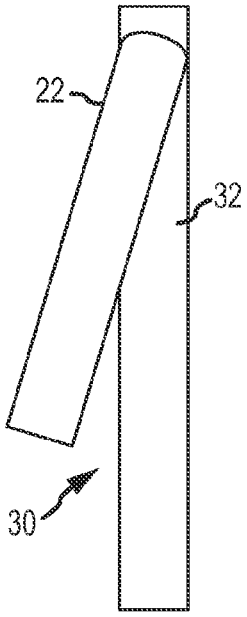
FIGS. 5A-5C are top views of the cigar holder with the cigar retention member in various respective positions with respect to the clamping member.
Figure 5B:
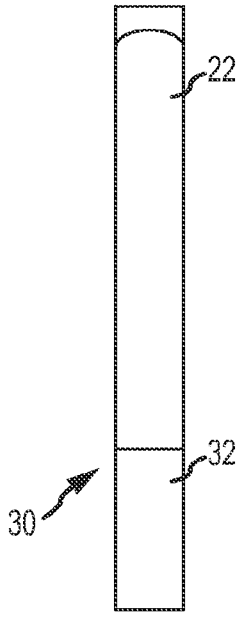
Figure 5C:
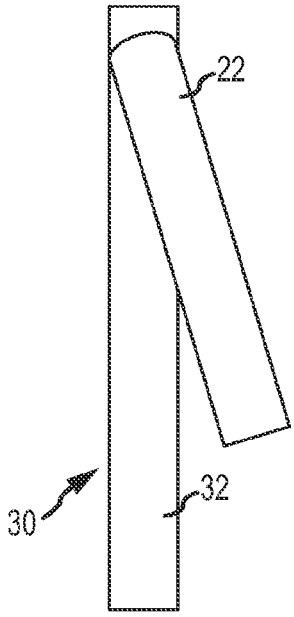

With further reference to FIGS. 5A-5C, the ball and socket joint defined by the ball 28 and socket 44 may also provide for movement of the cradle 22 with respect to the clamping assembly 30 in a second dimension different than the first dimension. As can be appreciated, the second dimension may correspond to rotation of the cradle 22 with respect to the clamping assembly 30. For example, the ball and socket joint may provide for a number of positions of the cradle 22 with respect to the clamping assembly 30 in the second dimension. For example, the cradle 22 may be positioned with respect to the clamping assembly 30 in a continuum of positions in the second dimension. For instance, the cradle 22 may be rotated with respect to the clamping assembly 30 in the second dimension through a range of angles of at least about 45 degrees. In another embodiment, the cradle 22 may be rotated with respect to the clamping assembly 30 in the second dimension though a range of angles of at least about 90 degrees. In various other embodiments, the cradle 22 may be rotated with respect to the clamping assembly 30 in the second dimension through a range of angles of at least about 180 degrees or even a full rotation of about 360 degrees. In another embodiment, a plurality of discrete relative positions of the cradle 22 with respect to the clamping assembly 30 may be provided in the second dimension.

In this regard, it will be appreciated that the cradle 22 may be positioned with respect to the clamping assembly 30 so as to retainably engage a cigar 1 in the cradle 22 when the clamping assembly 30 is attached to a number of different support structure arrangements. For example, the clamping assembly 30 may be attached to a horizontal support structure, a vertical support structure, or any support structure varying between horizontal and vertical. In turn, the cradle 22 may be positioned in the first and/or second dimension to as to supportably retain a cigar 1 with the cradle 22 to accommodate positioning of the cigar holder 1 with respect to vertical support structures, horizontal support structures, or any angle of support structure therebetween.

Figure 6:
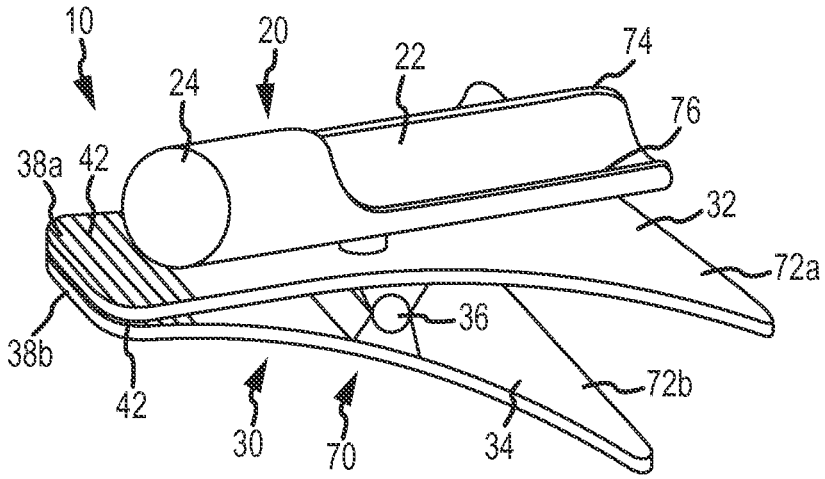
FIG. 6 is a perspective view of another embodiment of a cigar holder.
Figure 7:
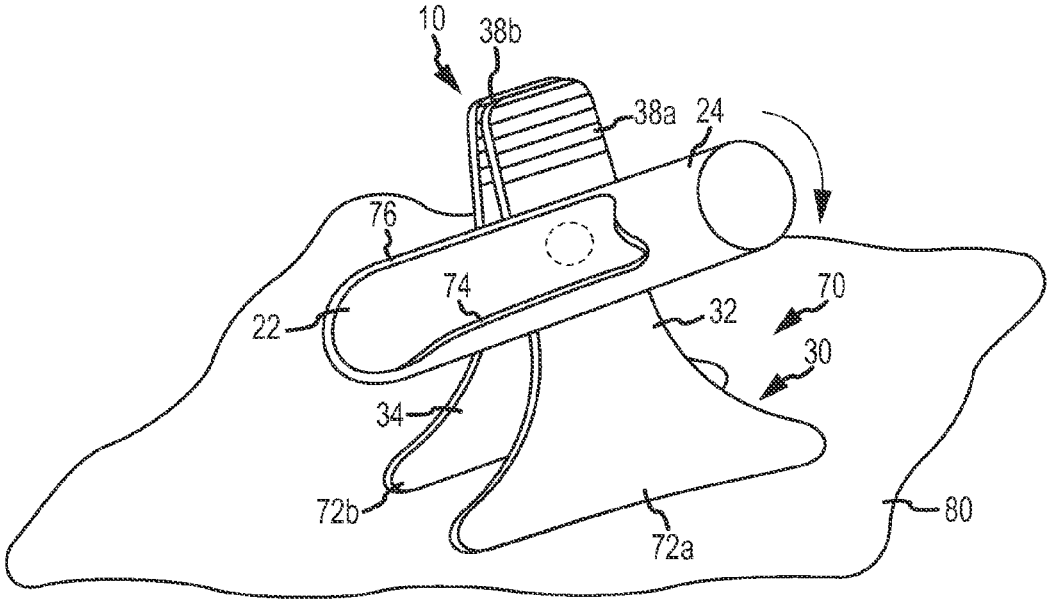
FIG. 7 is a perspective view of the cigar holder of FIG. 6 disposed with respect to a surface.

Another embodiment of a cigar holder 10 is shown in FIGS. 6 and 7. It will be appreciated that while it may be convenient in some instances to use the clamping assembly 30 to secure the cigar holder 10 to a support structure, it may also at times be advantageous to use the cigar holder 10 in other contexts. In this regard, as shown in FIGS. 6 and 7, an embodiment of a cigar holder 10 may be provided that includes a support structure 70. The support structure 70 may be provided on a portion of the clamping assembly 30. For example, the first handle portion 32 may have a base portion 72*a* provided on an opposite side of the first handle portion 32 as the first jaw end portion 38*a*. Additionally or alternatively, the second handle portion 34 may have a base portion 72*b* provided on an opposite side of the second handle portion 34 as the second jaw end portion 38*b*. Accordingly, the support structure 70 may provide a supportive base defined by the first base portion 78*a* and/or second base potion 78*b* to support the cigar holder 10 on a surface 80.

As shown, the cigar retention member 20 may be adjusted relative to the clamping assembly 30 when the cigar holder 10 is supported by the support structure 70 to retain a cigar in the cigar cradle 22. The cigar cradle 22 may include an extended sidewall portion 74 that extends further in the second direction (i.e., corresponding to the circumference of a cigar disposed in the cradle 22) than a corresponding sidewall portion 76 on an opposite side of the cradle 22. In another embodiment, the adjustment between the cigar retention member 20 and the clamping assembly 30 as described above with respect to FIGS. 3A-5C may be sufficient to allow for positioning of the cigar cradle 22 so as to retain a cigar 1 in the cigar retention member 20 when the cigar holder 10 is supported on a surface 80 by the support structure 70.

Furthermore, while the first base portion 78*a* and second base portion 78*b* are shown and described as being on opposite sides of the first handle portion 32 and the second handle portion 34, respectively, in another embodiment, the first base portion 78*a* and/or second base portion 78*b* may be provided at other locations on the first or second handle portions 32 and 34. For example, the first jaw end portion 38*a* and/or the second jaw end portion 38*b* may comprise an enlarged or expanded portion that serves as a base portion that is capable of supporting the cigar holder 10.

In other embodiments, the cigar holder 10 may include additional features appurtenant to the context in which it is used. For example, the cigar holder 10 may include an ash tray to collect spent ash from the cigar 1. In another embodiment, one or more accessory holders may be provided for securing ancillary items such as, for example, a lighter, matches, a cigar cutter, golf balls, golf tees, a golf ball repair tool, a golf ball marker, gloves, sunglasses, etc. Furthermore, one or more tools may be integrated with an embodiment of the cigar holder such as, for example, a golf ball repair tool, a cigar cutter, a lighter, a bottle opener, etc.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only the preferred embodiment and variants thereof have been shown and described and that all changes and modifications that come within the spirit of the invention are desired to be protected.

What is claimed is:

1. A cigar holder, comprising:

a cigar retention member operable to retainably engage a cigar without application of a compressive force to the cigar, the cigar retention member comprising a cigar cradle extending in a first direction corresponding to a length of the cigar and a second direction corresponding to a circumference of the cigar, wherein the cigar cradle comprises;

a riser disposed at a first end portion thereof, the riser operable to dispose a lit end portion of the cigar in a spaced apart relation from the cigar cradle adjacent to the lit end portion of the cigar, and a hood at a second end portion thereof opposite the first end portion, wherein at least a portion of a cut end portion of the cigar is substantially surrounded by the hood when the cigar is retainably engaged by the cigar retention member; and a clamping assembly operable to clampingly engage a support structure, wherein the cigar retention member is supportably engaged with the clamping assembly.

2. A cigar holder according to claim 1, wherein the cigar cradle extends in the first direction at least about 5 cm.

3. A cigar holder according to claim 2, wherein the cigar cradle extends in the second direction sufficient to retainably engage a cigar with a diameter of up to about 2.5 cm.

4. A cigar holder according to claim 3, wherein the cigar retention member is adjustably positionable with respect to the clamping assembly with respect to at least a first degree of freedom.

5. A cigar holder according to claim 4, wherein the cigar retention member is adjustably positionable with respect to the clamping assembly through at least 30 degrees of rotation in the first degree of freedom.

6. A cigar holder according to claim 5, wherein the cigar retention member is adjustably positionable with respect to the clamping assembly with respect to at least a second degree of freedom of movement between the cigar retention member and the clamping assembly.

7. A cigar holder according to claim 1, wherein the riser comprises a heat-resistant material.

8. A cigar holder according to claim 1, wherein at least a majority of the cut end portion of the cigar is surrounded by the hood when the cigar is retainably engaged by the cigar retention member.

9. A cigar holder according to claim 1, wherein the clamping assembly comprises a support structure defining a base portion, the base portion being positionable with respect a surface to supportably position the cigar retention member with respect to the surface.

10. A cigar holder according to claim 9, wherein the clamping assembly comprises a first handle portion and a second handle portion, the first and second handle portions being disposable with respect to one another, wherein the first and second handle portions define a jaw member of the clamping assembly, and wherein the first and second handle portions comprise the support structure defining the base.

11. A cigar holder according to claim 10, wherein the jaw member is selectively openable to define a jaw span of at least about 7.5 cm.

12. A method for retaining a cigar, comprising:

supportably engaging the cigar holder with a support structure by clamping a clamping assembly of the cigar holder to the support structure;

positioning a cigar retention member based on a position of the cigar holder as supportably engaged with the support structure;

disposing a cigar with respect to a cigar cradle of the cigar retention member that extends in a first direction corresponding to a length of the cigar and a second direction corresponding to a circumference of the cigar, wherein the disposing includes contacting a riser disposed at a first end portion of the cigar cradle with a lit end portion of the cigar to dispose the cigar in a spaced apart relation from the cigar cradle adjacent to the lit end portion of the cigar and disposing a cut end portion of the cigar relative to a hood at a second end portion of the cigar cradle opposite the first end portion so that the cut end portion is substantially surrounded by the hood when the cigar is disposed relative to the cigar cradle; and retaining the cigar in the cigar cradle of the cigar retention member, wherein the retaining is without application of a compressive force to the cigar.

13. A method according to claim 12, wherein the supportably engaging operation comprise resting the cigar holder on a surface, wherein the cigar holder is supported by a support structure including a supportive base.

* * * * *

UNITED STATES PATENT AND TRADEMARK OFFICE

CERTIFICATE OF CORRECTION

PATENT NO. : 8,757,168 B2
APPLICATION NO. : 13/544428
DATED : June 24, 2014
INVENTOR(S) : Gary Wills It is certified that error appears in the above-identified patent and that said Letters Patent is hereby corrected as shown below:

Title Page, item (76), delete "Jaspar, CO" and therefore insert --Jasper, GA--

Signed and Sealed this
Fourteenth Day of October, 2014

Michelle K. Lee

Michelle K. Lee
*Deputy Director of the United States Patent and Trademark Office*